US007848535B2

(12) United States Patent
Akino

(10) Patent No.: US 7,848,535 B2
(45) Date of Patent: Dec. 7, 2010

(54) NARROW DIRECTIONAL MICROPHONE

(75) Inventor: Hiroshi Akino, Machida (JP)

(73) Assignee: Kabushiki Kaisha Audio-Technica, Machida-shi, Tokyo (JP)

( * ) Notice: Subject to any disclaimer, the term of this patent is extended or adjusted under 35 U.S.C. 154(b) by 1166 days.

(21) Appl. No.: 11/494,556

(22) Filed: Jul. 28, 2006

(65) Prior Publication Data

US 2006/0285714 A1 Dec. 21, 2006

(51) Int. Cl.
*H04R 9/08* (2006.01)

(52) U.S. Cl. ..... 381/356; 381/338; 381/355; 381/357

(58) Field of Classification Search ..... 381/355–361, 381/338
See application file for complete search history.

(56) References Cited

U.S. PATENT DOCUMENTS 3,444,955 A * 5/1969 Hoffmann ..... 181/158
3,793,489 A * 2/1974 Sank ..... 381/92
4,399,327 A * 8/1983 Yamamoto et al. ..... 381/92
4,421,957 A * 12/1983 Wallace, Jr. ..... 381/338
4,757,546 A * 7/1988 Akino ..... 381/357
6,418,229 B1 * 7/2002 Staat ..... 381/357

* cited by examiner

*Primary Examiner*—Curtis Kuntz
*Assistant Examiner*—Ryan Robinson
(74) *Attorney, Agent, or Firm*—Manabu Kanesaka

(57) ABSTRACT

There is provided a narrow directional microphone which houses a plurality of microphone units of a first-order pressure gradient type (condenser microphone) while achieving reduced weight and compact shape at the same time. The narrow directional microphone includes a cylindrical microphone case that is also used as an acoustic tube and two or more microphone units housed in the microphone case, each having a front acoustic terminal and a rear acoustic terminal. A hole communicating with the inside and outside of the microphone case is provided in the peripheral wall of the microphone case, and an acoustic resistance material is provided on the inside of the microphone case so as to close the hole. The microphone units are arranged adjacently on the rear end side of the microphone case with a predetermined gap being provided between the microphone unit and the inner peripheral surface of the microphone case in a state in which the front acoustic terminal side is directed to the tip end side of the microphone case.

5 Claims, 1 Drawing Sheet

NARROW DIRECTIONAL MICROPHONE

TECHNICAL FIELD

The present invention relates to a narrow directional microphone in which a microphone unit having a front sound terminal and a rear sound terminal is incorporated in a cylindrical microphone case. More particularly, the present invention relates to a narrow directional microphone which incorporates a plurality of microphone units.

BACKGROUND ART

For a microphone used in an especially important place such as a conference room or a broadcasting station, a plurality of microphones are often installed at predetermined positions on a desk etc. because it is necessary to take measures against a break of sound caused by a failure of microphone or to individually connect the microphones to many loudspeakers or recorders.

In this case, since a large number of microphones are erected in front of a speaker, an installation space for installing the microphones must be secured, and moreover there arises a problem in that the speaker cannot be seen well from a visual point of view.

For this reason, in some conventional microphones, the number of installed microphones is decreased as far as possible by incorporating two or three systems of microphone units in one microphone housing in order that the installation space can be secured and the speaker can be seen easily.

On the other hand, there is available a narrow directional microphone in which an acoustic tube is attached to the front sound terminal side of a microphone unit having a front and rear sound terminals to make the directivity narrow. Conventionally, the narrow directional microphones having various constructions have been proposed including the narrow directional microphone disclosed in Japanese Patent Application Publication No. S62-118698.

However, in the field of narrow directional microphone, unlike the aforementioned microphone used for conference etc., there is no example in which a plurality of microphone units are housed in one cylindrical microphone case as far as the inventor knows.

As shown in FIG. 2, if narrow directional microphones 3, 3 of independent two systems are housed in one cylindrical microphone case 2 to form a narrow directional microphone body 1, as is apparent from the above-described conventional example, the microphone body 1 is formed by installing a microphone unit 4 having a front acoustic terminal 4*a* and a rear acoustic terminal 4*b* so that the rear end of an acoustic tube 5 is attached to the front acoustic terminal 4*a* side in an enclosed state. Also, the acoustic tube 5 is provided with slit holes 6 in the peripheral wall portion thereof, and the slit holes 6 are covered with an acoustic resistance material 7 so as to provide narrow directivity.

In the case where the narrow directional microphone body 1 is formed in this manner, problems described below arise. The two narrow directional microphones 3 must be arranged in the microphone case 2 with a gap t being provided therebetween to prevent acoustic interference caused, for example, by resonance between the acoustic tubes 5, 5.

Therefore, the size of the microphone case 2 itself increases as shown in FIG. 2, and also the total weight of the microphone body 1 increases because two acoustic tubes 5 are housed in the microphone case 2. Especially when the acoustic tubes 5 are formed of a metallic material, the weight increases remarkably.

Also, in the case where the microphone body 1 having such a large-size construction is attached to a flexible pipe, not shown, that is used as a gooseneck stanchion, the flexible pipe cannot withstand the weight of the microphone body 1, and hence is turned downward by the gravity, so that there is a fear that the microphone body 1 cannot be adjustably moved to a desired position.

SUMMARY OF THE INVENTION

Accordingly, an object of the present invention is to provide a narrow directional microphone that can achieve a reduced total weight and a compact entire shape at the same time even if a plurality of microphone units each having a front acoustic terminal and a rear acoustic terminal are housed in one cylindrical microphone case.

To achieve the above object, the present invention provides a narrow directional microphone including a cylindrical microphone case that is also used as an acoustic tube and two or more microphone units housed in the microphone case, each having a front acoustic terminal and a rear acoustic terminal, wherein a hole communicating with the inside and outside of the microphone case is provided in the peripheral wall of the microphone case, and an acoustic resistance material is provided on the inside of the microphone case so as to close the hole; and the microphone units are arranged adjacently in a rear end portion of the microphone case with a predetermined gap being provided between the microphone unit and the inner peripheral surface of the microphone case in a state in which the front acoustic terminal side is directed to the tip end side of the microphone case.

According to the present invention, since two or more microphone units are housed in one microphone case, reduced weight and compact shape can be achieved at the same time.

Therefore, in the case where the narrow directional microphone is used as a sound pickup portion of a gooseneck microphone, if a stanchion for supporting the microphone as a stand arm is a flexible pipe, the narrow directional microphone can be used stably while the position thereof is adjusted appropriately.

DETAILED DESCRIPTION

Figure 1:
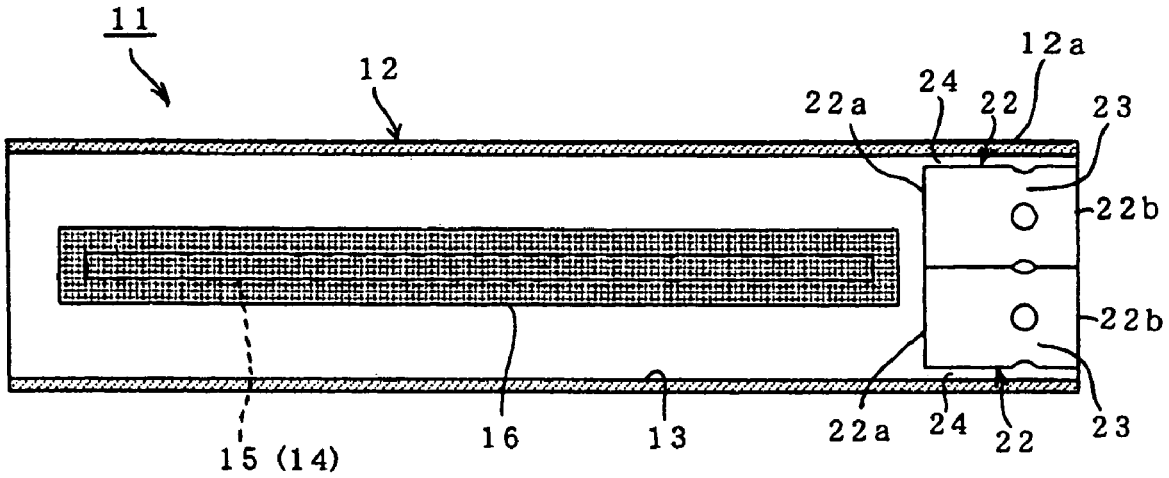
FIG. 1 is an enlarged sectional view showing one example of the present invention.

Referring to FIG. 1, a narrow directional microphone 11 in accordance with the present invention includes a cylindrical microphone case 12 that is also used as an acoustic tube and a plurality of (two in this example) microphone units 22 each having a front acoustic terminal 22*a* and a rear acoustic terminal 22*b*.

The microphone case 12 consists of a metallic pipe formed of aluminum etc., and both ends in the axial direction thereof are open. The inside diameter of the microphone case 12 may be determined appropriately according to the outside diameter and the number of the microphone units 22 housed. The microphone case 12 may be made of a synthetic resin.

In the peripheral wall portion of the microphone case 12, there is provided a hole 14 for acoustic resistance, which consists of a slit hole 15 formed along the axis direction. In this example, the slit hole 15 is arranged at four places at angular intervals of 90 degrees in the circumferential direction of the microphone case 12.

On the holes 14, an acoustic resistance material 16 consisting of a nylon mesh, a nonwoven fabric, or the like is affixed from the inside surface 13 side of the microphone case 12. In this example, the hole 14 consists of the slit hole 15 formed along the axis direction of the microphone case 12. However, the hole 14 may be arranged, for example, by providing a plurality of communication holes communicating with the inside and outside of the microphone case 12 at predetermined intervals along the axis direction.

As each of the microphone units 22, a first-order pressure gradient type unit having the front acoustic terminal 22*a* and the rear acoustic terminal 22*b* is used. The microphone unit 22 is housed in a rear end portion 12*a* of the microphone case 12 in a state in which the front acoustic terminal 22*a* is directed to the tip end side (the left-hand side in the example shown in FIG. 1) of the microphone case 12. Usually, as the narrow directional microphone unit of this type, a condenser microphone unit is used.

In this case, the two microphone units 22 are arranged adjacently in the microphone case 12 in a state in which outer peripheral surfaces 23 thereof are in contact with each other. Further, each of the microphone units 22 is housed in a state in which a gap 24 is formed between the outer peripheral surface 23 thereof and the inside surface 13 of the microphone case 12. The reason for this is that a sound from the rear of the microphone case 12 enters into the rear acoustic terminal 22*b*.

Also, the microphone unit 22 is housed stably in the rear end portion 12*a* of the microphone case 12 in a state of being held on the stanchion side serving as a stand arm, not shown, connected to the rear end side of the microphone case 12.

The microphone unit 22 may be fixed with an elastic material such as rubber being interposed in the gap 24 between the outer peripheral surface 23 thereof and the inside surface 13 of the microphone case 12. In this case, it is necessary to leave a sound passage between the front acoustic terminal 22*a* and the rear acoustic terminal 22*b*.

According to the present invention, by housing the two microphone units 22 in the microphone case 12 in this manner, the narrow directional microphone 11 of independent two systems can be obtained without increasing the equipment size.

Figure 2:
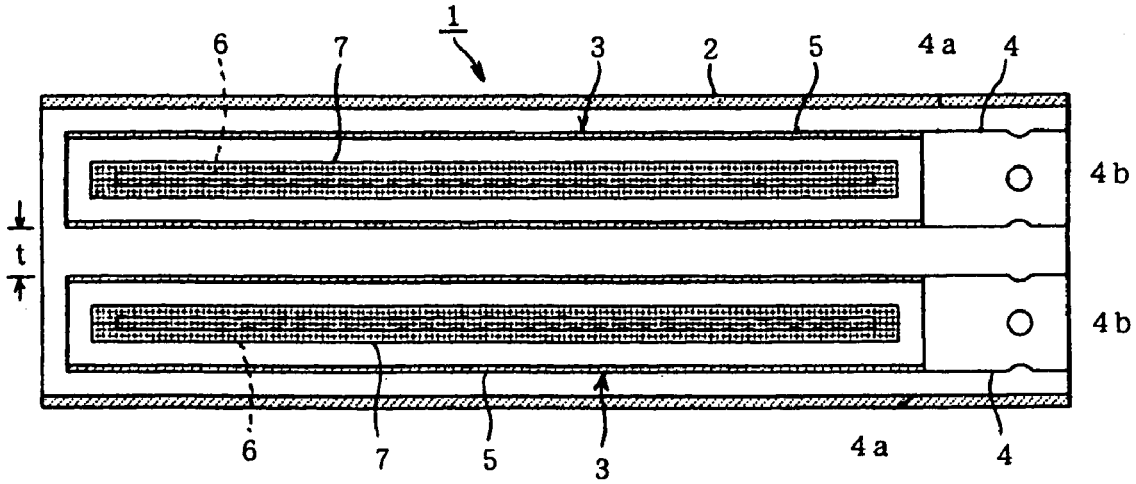
FIG. 2 PRIOR ART
FIG. 2 is an explanatory view showing a state in which narrow directional microphones of independent two systems are housed in one cylindrical microphone case to form one microphone body.

In this case, since the microphone unit 22 is not connected with the acoustic tube 5 shown in FIG. 2, even if the microphone units 22 are arranged adjacently so that the outer peripheral surfaces 23 thereof are in contact with each other, acoustic interference such as resonance is not encountered because the entire size is small. Therefore, the narrow directional microphone 11 can achieve reduced weight and compact shape at the same time by making the acoustic tube itself unnecessary.

In the case where the narrow directional microphone 11 is used as a sound pickup portion of a gooseneck microphone, if the stanchion, not shown, for supporting the microphone as a stand arm is a flexible pipe, the narrow directional microphone 11 can be used stably while the position thereof is adjusted appropriately, unlike the microphone having the construction shown in FIG. 2.

The above is an explanation of the present invention given on the basis of the example shown in FIG. 1. The specific construction of the narrow directional microphone is not limited to the above-described one. For example, three or more microphone units 22 can be housed in the microphone case 12 if desired. Also, the hole 14 provided in the microphone case 12 is not limited to the slit hole 15 shown in FIG. 1, and may be formed by many circular holes, many elongated holes, or any hole having an appropriate opening shape. Also, the acoustic resistance material 16 may cover the hole 14 from the outside of the microphone case 12.

The invention claimed is:

1. A narrow directional microphone comprising:

a cylindrical microphone case that is also used as an acoustic tube, two or more microphone units housed in the microphone case, each having a front acoustic terminal and a rear acoustic terminal, a hole communicating an inside of the microphone case with an outside of the microphone case, provided in a peripheral wall of the microphone case, and an acoustic resistance material provided on one of the inside and outside of the microphone case so as to close the hole, wherein the microphone units are arranged in parallel so as to be side-by-side and are arranged adjacent a rear end portion of the microphone case with a predetermined gap between each microphone unit and an inner peripheral surface of the microphone case in a state in which a front acoustic terminal side is directed to a tip end side of the microphone case.

2. A narrow directional microphone as claimed in claim 1, wherein the microphone units are disposed so that peripheral side surfaces thereof are in contact with each other.

3. A narrow directional microphone as claimed in claim 2, wherein the front acoustic terminal of each microphone unit directly faces an inside of the microphone case without having an acoustic tube thereon.

4. A narrow directional microphone as claimed in claim 3, wherein the hole is elongate and extends axially along the microphone case, and the microphone units are arranged at one lateral side of the microphone case away from a side of the hole.

5. A narrow directional microphone as claimed in claim 4, further comprising a plurality of additional holes which are each elongate and extend axially along the microphone case, the additional holes being spaced about the periphery of the microphone case.

* * * * *